US010148037B2

(12) United States Patent
Hirota

(10) Patent No.: US 10,148,037 B2
(45) Date of Patent: Dec. 4, 2018

(54) LEVER-TYPE CONNECTOR

(71) Applicant: Sumitomo Wiring Systems, Ltd., Yokkaichi, Mie (JP)

(72) Inventor: Masanori Hirota, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 15/877,452

(22) Filed: Jan. 23, 2018

(65) Prior Publication Data

US 2018/0248310 A1 Aug. 30, 2018

(30) Foreign Application Priority Data

Jan. 25, 2017 (JP) ..... 2017-010834

(51) Int. Cl.

| | |
|---|---|
| ***H01R 13/629*** | (2006.01) |
| ***H01R 13/639*** | (2006.01) |
| ***H01R 24/00*** | (2011.01) |
| ***H01R 12/50*** | (2011.01) |
| ***H01R 13/453*** | (2006.01) |

(52) U.S. Cl.

CPC ... *H01R 13/62933* (2013.01); *H01R 13/4538* (2013.01); *H01R 13/62938* (2013.01); *H01R 13/62966* (2013.01); *H01R 13/62972* (2013.01); *H01R 13/639* (2013.01); *H01R 23/02* (2013.01); *H01R 23/7073* (2013.01)

(58) Field of Classification Search

CPC ..... H01R 13/62933; H01R 13/62938; H01R 13/62966; H01R 13/62972; H01R 13/639

See application file for complete search history.

(56) References Cited

U.S. PATENT DOCUMENTS 6,644,992 B2 * 11/2003 Maegawa ..... H01R 13/62938 439/157
6,692,274 B2 * 2/2004 Maegawa ..... H01R 13/62933 439/157
6,783,388 B2 * 8/2004 Matsushita ..... H01R 13/6295 439/352
7,249,958 B2 * 7/2007 Ishikawa ..... H01R 13/631 439/140

(Continued)

FOREIGN PATENT DOCUMENTS

JP 2016-213081 12/2016

*Primary Examiner* — Felix O Figueroa

(74) *Attorney, Agent, or Firm* — Gerald E. Hespos; Michael J. Porco; Matthew T. Hespos

(57) ABSTRACT

A connector includes a lever (50) to connect a male housing (20) and a female housing (10) by rotating from an initial position to a connection position. The male housing (20) includes a receptacle (22) and a moving plate (30) movable in a connecting direction of the housings (10, 20). The lever (50) includes plates (51) extending along an outer surface of the male housing (20). The moving plate (30) includes a wall (33) extending along an inner surface of the receptacle (22). The plate (51) of the lever (50) includes an initial lock (54) to limit rotation of the lever (50) toward the connection position by being locked to the receptacle (22). The wall (33) includes unlocking portions (38) to push the initial locking portions (54) in an unlocking direction by contacting the female housing (10). The unlocking portion (38) is separated from surroundings by long narrow slits (39).

5 Claims, 9 Drawing Sheets

(56) References Cited

U.S. PATENT DOCUMENTS

| | | | | |
|---|---|---|---|---|
| 7,448,888 | B2 * | 11/2008 | Okano | H01R 13/4538 439/157 |
| 9,520,669 | B2 * | 12/2016 | Gerwatowski | H01R 13/44 |
| 9,787,024 | B2 * | 10/2017 | Obata | H01R 13/62938 |
| 2016/0336686 | A1 | 11/2016 | Obata | |

* cited by examiner

LEVER-TYPE CONNECTOR

BACKGROUND

Field of the Invention. The invention relates to a lever-type connector.

Description of the Related Art. Japanese Unexamined Patent Publication No. 2016-213081 discloses a lever-type connector in which a lever for connecting a male connector to a mating female connector is mounted on the male connector. The male connector has male terminal fittings including tabs accommodated therein. The lever is mounted rotatably on the male connector, and the connectors can be connected properly by rotating the lever from an initial position to a connection position. The male connector has a moving plate with through holes through which the tabs of the male terminal fittings can be passed. The moving plate is movable from tip ends to the base ends of the tabs as the male connector and the female connector are connected. A housing of the male connector includes a receptacle that fits externally to a housing of the female connector, and the lever includes two arms extending along both side surfaces of the receptacle. The moving plate is accommodated inside the receptacle and includes a tubular peripheral wall extending along the inner surface of the receptacle.

A resilient locking piece is provided on the arm of the lever and functions to hold the lever at the initial position. The resilient locking piece is a cantilever and a locking projection on a tip part of the resilient locking piece is lockable to the receptacle. The receptacle is formed with first grooves into which the locking projections are insertable, and the lever is held at the initial position by having the locking projections lock to peripheral edges of the first grooves. Second grooves are formed on the peripheral wall of the moving plate at positions corresponding to the first grooves of the receptacle. When the housing of the female connector is fit into the receptacle of the male connector, unlocking ribs are inserted into the first and second grooves, interfere with the locking projections in the first grooves and push the locking projections to outside from the first grooves. In this way, a locked state between the locking projections and the peripheral edges of the first grooves is released, enabling the lever to rotate toward the connection position.

However, in the configuration described above, the moving plate has to be formed with relatively large grooves (openings) through which the unlocking ribs of the female connector can pass. Thus, it has been difficult to enhance strength.

The invention was completed on the basis of the above situation and aims to provide a lever-type connector capable of enhancing strength.

SUMMARY

The invention is directed to a lever-type connector with a male housing configured to accommodate a male terminal fitting including a tab. A lever is mounted rotatably on the male housing and is configured to connect the male housing and a mating female housing by rotating from an initial position to a connection position. The male housing includes a receptacle capable of surrounding the tab. A moving plate is in the receptacle and is movable in a connecting direction of the male housing and the female housing. The moving plate has a through hole through which the tab is passed and includes a wall extending along an inner surface of the receptacle. The wall can fit externally to the female housing, The lever includes a plate extending along an outer surface of the male housing. The plate of the lever includes an initial locking portion configured to limit rotation of the lever toward the connection position by being locked to the receptacle when the lever is at the initial position. The wall of the moving plate includes an unlocking portion displaceable to push the initial locking portion in an unlocking direction by contacting the female housing fit inside the wall, and the unlocking portion is separated from the surroundings by a long and narrow slit.

According to the invention, strength can be enhanced since the wall of the moving plate need not be formed with any large groove as before.

The unlocking portion may include a projection projecting inward of the wall, and the unlocking portion is displaced by the contact of the outer surface of the female housing with the projection. According to this configuration, it is not necessary to provide a releasing rib for releasing initial locking on the outer surface of the female housing. Thus, the structure of the female housing can be simplified.

The projection of the unlocking portion may have a tapered surface inclined to gradually increase a projecting amount toward a front side in the connecting direction of the female housing. According to this configuration, a displacement amount of the unlocking portion gradually increases as the female housing moves forward. Thus, the male housing and the female housing can be connected smoothly.

The unlocking portion and the female housing may include separation restricting portions configured to restrict the separation of the female housing by locking each other. According to this configuration, the separation restricting portions prevents detachment of the female housing before the rotation of the lever.

DETAILED DESCRIPTION

One specific embodiment of the present invention is described in detail with reference to FIGS. 1 to 9.

Figure 1:
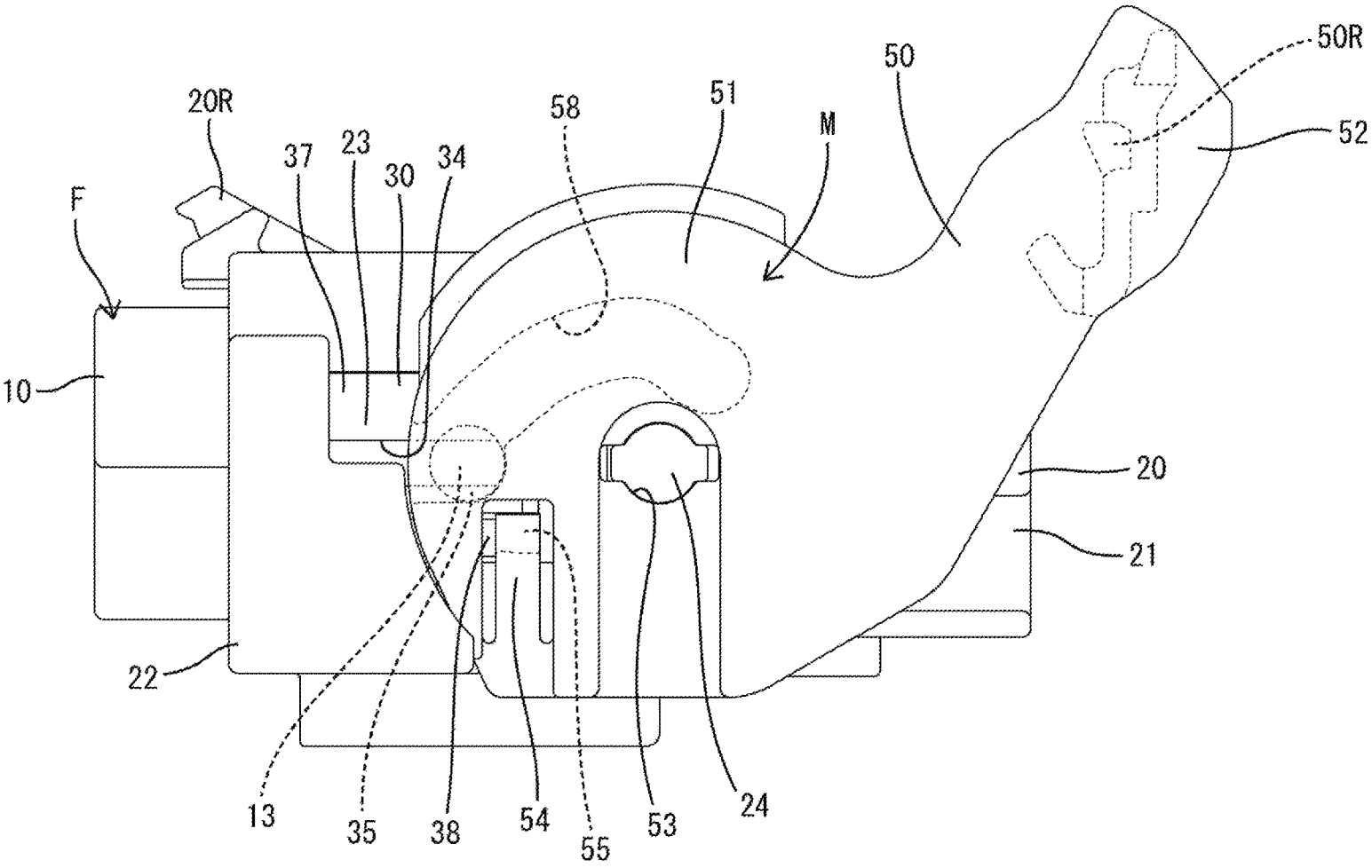
FIG. 1 is a side view of a lever-type connector in one embodiment showing a state where a male connector and a female connector are temporarily connected.
Figure 2:
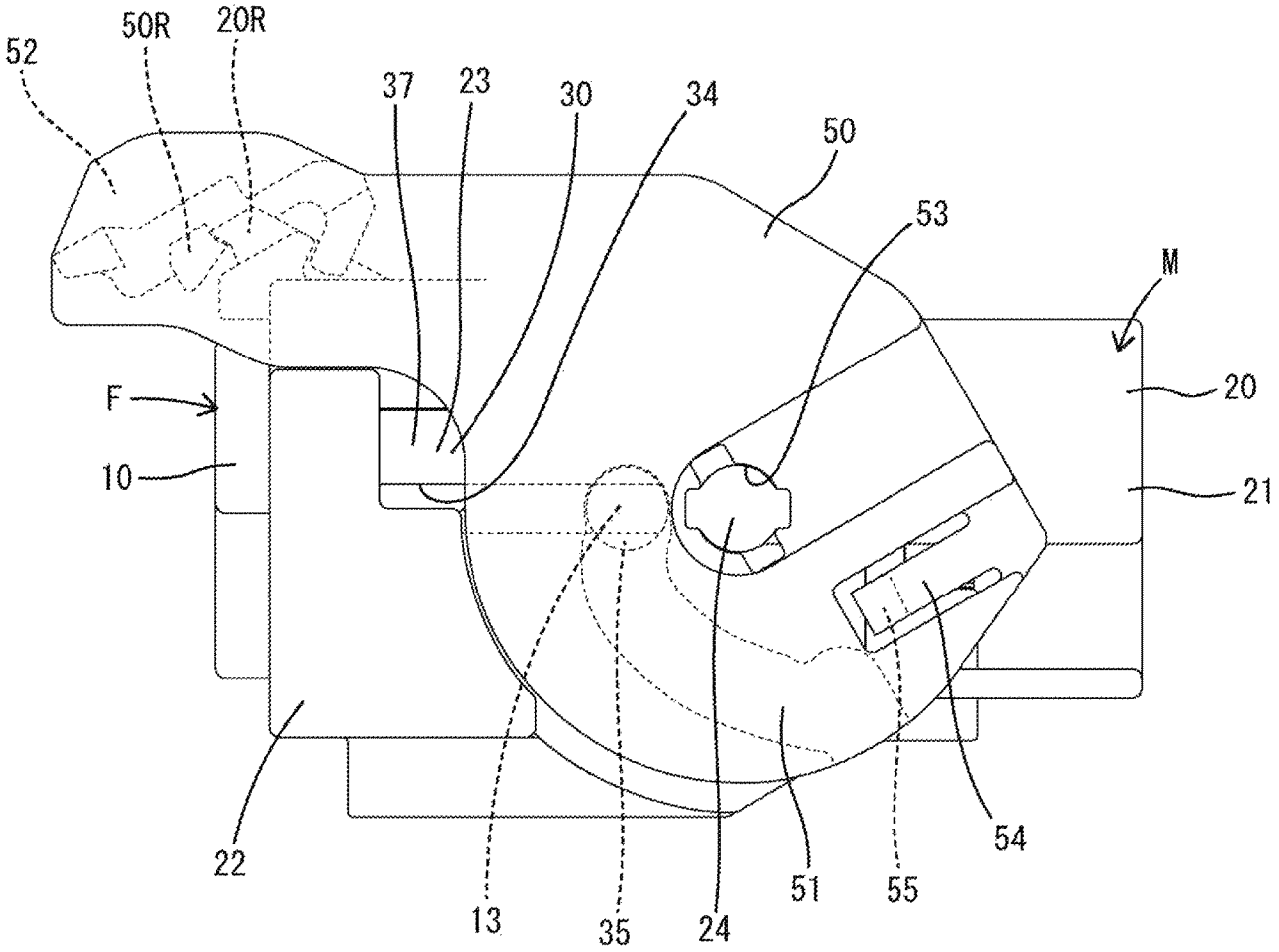
FIG. 2 is a side view showing a state where the male connector and the female connector are properly connected.

A lever-type connector in this embodiment includes a male connector M and a female connector F connectable to each other, and a lever 50 to be operated in connecting or separating the male connector M and the female connector F. In the following description, in each constituent member, connection surface sides in both connectors M, F (left side of FIG. 1 in the male connector M, right side of FIG. 1 in the female connector F) are respectively referred to as fronts, and upper and lower sides of FIG. 1 are referred to as upper and lower sides.

The female connector F includes female terminal fittings connected to end parts of unillustrated wires and a female housing 10 for accommodating the female terminal fittings.

Figure 3:
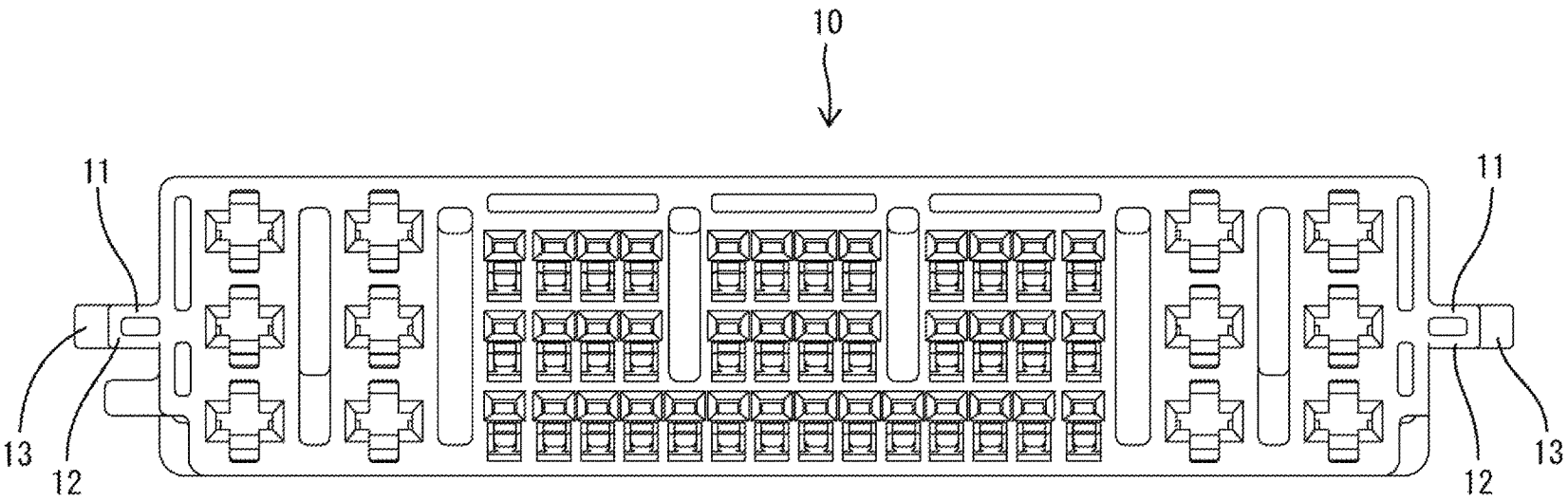
FIG. 3 is a front view of a female housing.

The female housing 10 is made of synthetic resin and, as shown in FIG. 3, in the form of a block long in a lateral direction as a whole and capable of accommodating a plurality of female terminal fittings inside.

Left and right female-side projections 11 are provided respectively on left and right side surfaces of the female housing 10. The female-side projections 11 are insertable into plate grooves 34 of a moving plate 30 to be described later.

Figure 4:
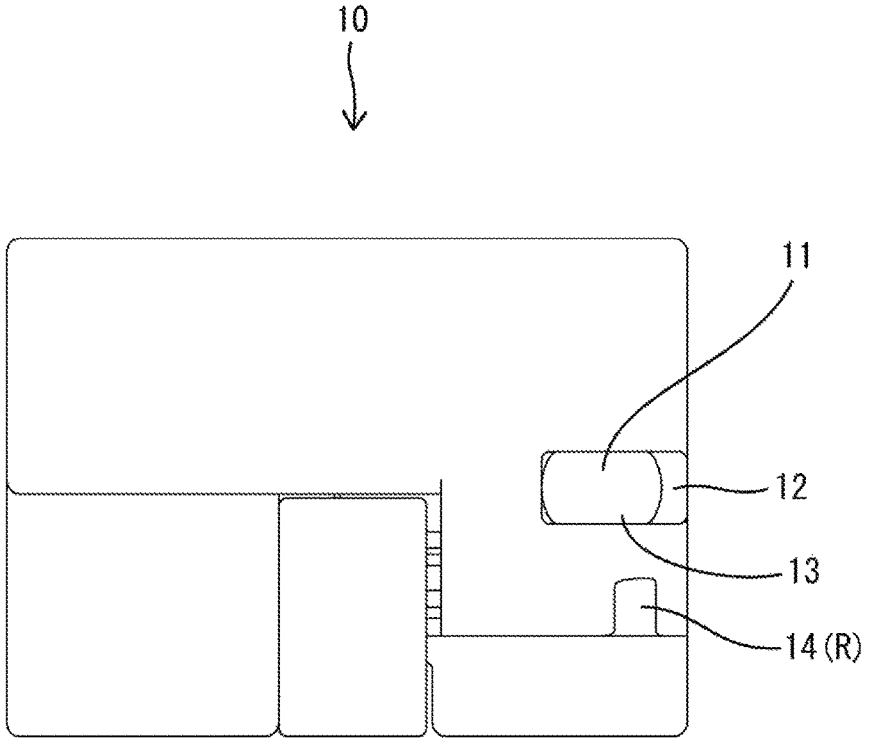
FIG. 4 is a side view of the female housing.

A base end part of each female-side projection 11 serves as a penetrating portion 12 penetrating from the inside to the outside of the moving plate 30. As shown in FIG. 4, the penetrating portion 12 is a rectangular column having a rectangular cross-section long in a front-rear direction.

A tip part of the female-side projection 11 serves as a first cam 13 constituting a part of a cam pin engageable with a cam groove 58 of the lever 50. The first cam 13 fits to a second cam 35 of the moving plate 30 to be described later to constitute the cam pin. Both front and rear surfaces of the first cam 13 are arcuate and constitute parts of the outer peripheral surface of the cam pin. Note that a dimension of the first cam 13 in the front-rear direction is slightly shorter than that of the penetrating portion 12.

Further, separation restricting portions R are provided on both left and right side surfaces of the female housing 10 (see FIG. 4) for restricting the separation of the female connector F with the female connector F and the male connector M temporarily connected before the rotation of the lever 50. The separation restricting portions R are described later.

The male connector M includes male terminal fittings connected to end parts of unillustrated wires, a male housing 20 for accommodating the male terminal fittings and the lever 50 rotatably mounted on the male housing 20.

The male housing 20 is made of synthetic resin and includes a terminal accommodating portion 21 for accommodating male terminal fittings and a receptacle 22 externally fittable to the female housing 10. The receptacle 22 is a rectangular tube long in the lateral direction and projecting forward from the terminal accommodating portion 21, and collectively surrounds tabs T of the male terminal fittings (see FIG. 5).

Support shafts 24 serving as a center of rotation of the lever 50 are provided on both left and right side surfaces of the male housing 20 (see FIG. 1). The support shafts 24 coaxially project on the both left and right side surfaces of the male housing 20. The support shafts 24 are located substantially in centers in the front-rear direction and a vertical direction on the both left and right side surfaces of the male housing 20.

The male housing 20 has a locking mechanism 20R for restricting rotation of the lever 50 having reached the connection position toward the initial position. The locking mechanism 20R is provided on an upper corner part of the front end of the male housing 20.

Figure 5:
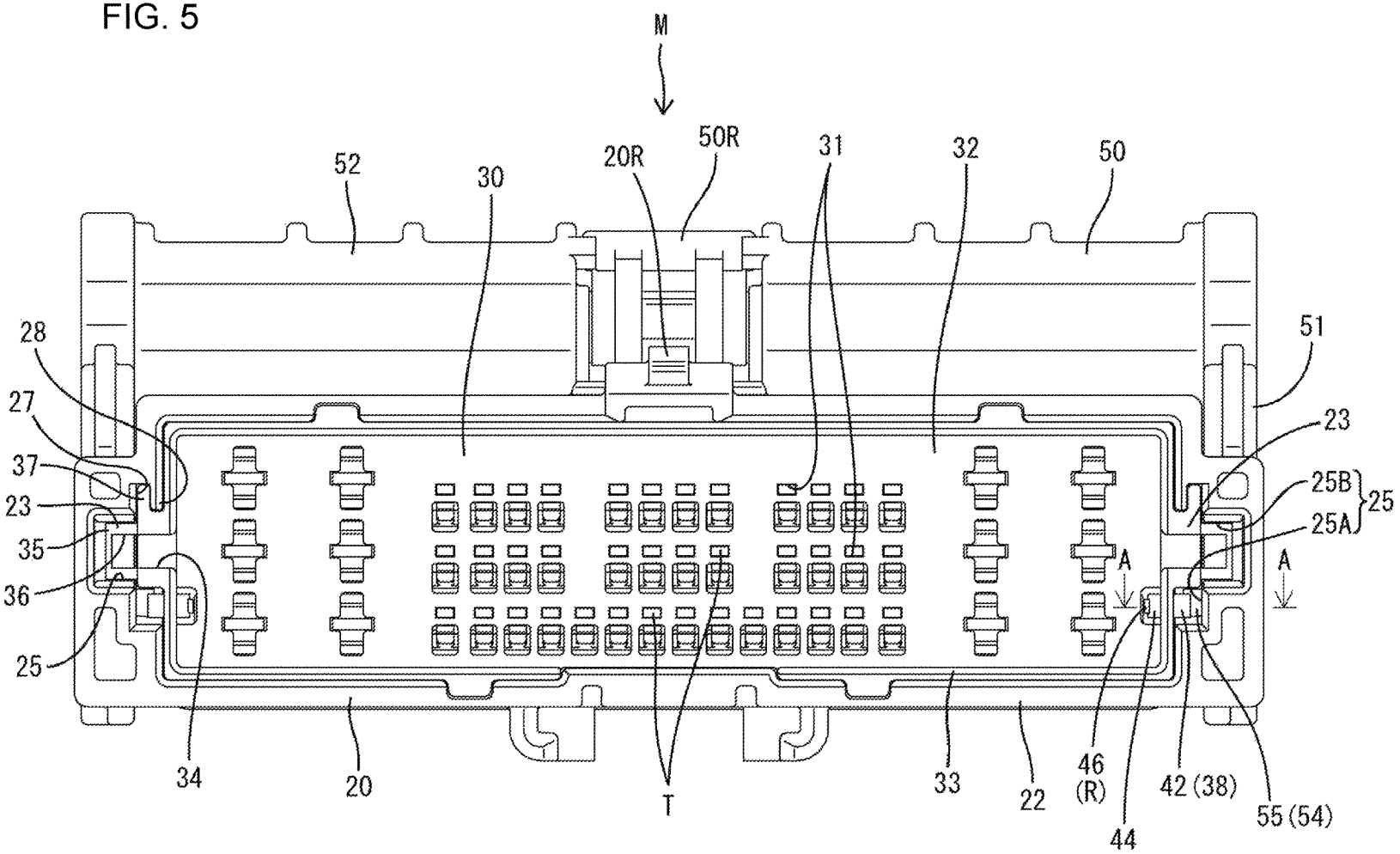
FIG. 5 is a front view of the male connector.

As shown in FIG. 5, grooves 25, lock projections 55 and disengaging projections 42 are provided in both left and right side walls of the receptacle 22. The grooves 25 receive male-side projections 23 on the moving plate 30. The lock projections 55 are on initial locking portions 54 of the lever 50 and the disengaging projections 42 are provided on unlocking portions 38 of the moving plate 30. The grooves 25 are formed by recessing the inner peripheral surface of the receptacle 22 and penetrate in the front-rear direction.

Figure 7:
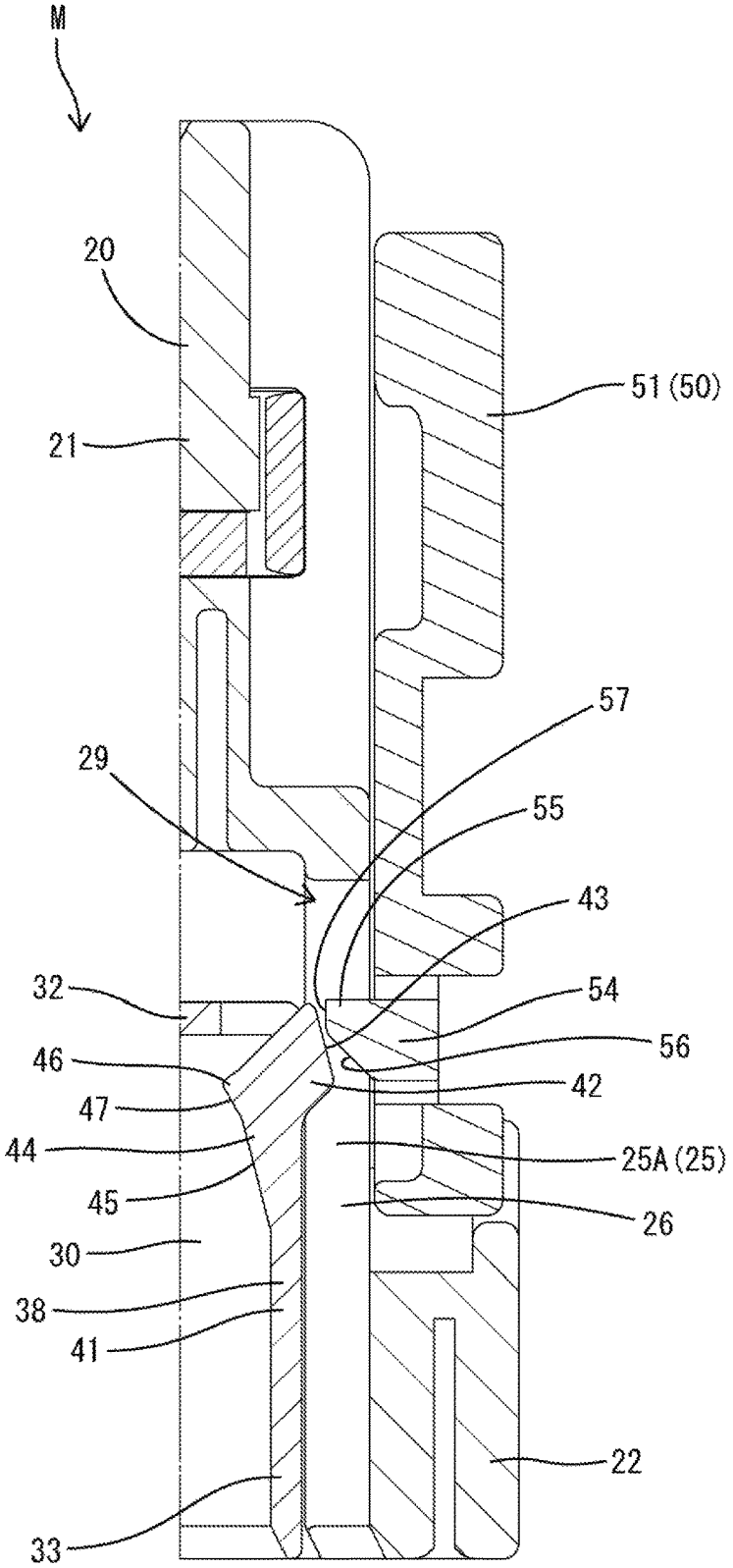
FIG. 7 is a cross-section at position A-A of FIG. 5 of the male connector showing a locked state of an initial locking portion.

A lower end part of each groove 25 includes an initial locking groove 25A that receives the lock projection 55 and the disengaging projection 42. A depth (dimension in the lateral direction of FIG. 5) of the initial locking groove 25A is smaller than a depth of a groove body 25B into which the male-side projection 23 is inserted. The initial locking groove 25A extends to the vicinity of the back end of the receptacle 22, as shown in FIG. 7. A locking surface 26 is formed on a lower peripheral surface of the initial locking groove 25A for engaging the initial locking portion 54.

As shown in FIG. 5, a narrow groove 27 is provided in the upper surface of the groove body 25A and receives a standing piece 37 of the male-side projection 23 to be described later. The narrow groove 27 is a cut substantially perpendicular to the upper surface of the groove body 25B. An inner wall 28 is provided along an inner side of the standing piece 37 in the narrow groove 27. The inner wall 28 extends over the entire length of the receptacle 22 and guides forward and rearward movements of the moving plate 30.

The moving plate 30 is mounted inside the receptacle 22. The moving plate 30 includes through holes 31 through which the tab portions T can pass, and is movable from tip sides to base sides of the tabs T (toward the back side of the receptacle 22) as the male connector M and the female connector F are connected.

The moving plate 30 is made of synthetic resin and includes a plate body 32 formed with through holes 31 and a wall 33 extending along the inner peripheral surface of the receptacle 22. The plate body 32 is a substantially rectangular plate long in the lateral direction and the wall 33 is a rectangular tube projecting forward from an outer edge part of the plate body 32.

Figure 6:
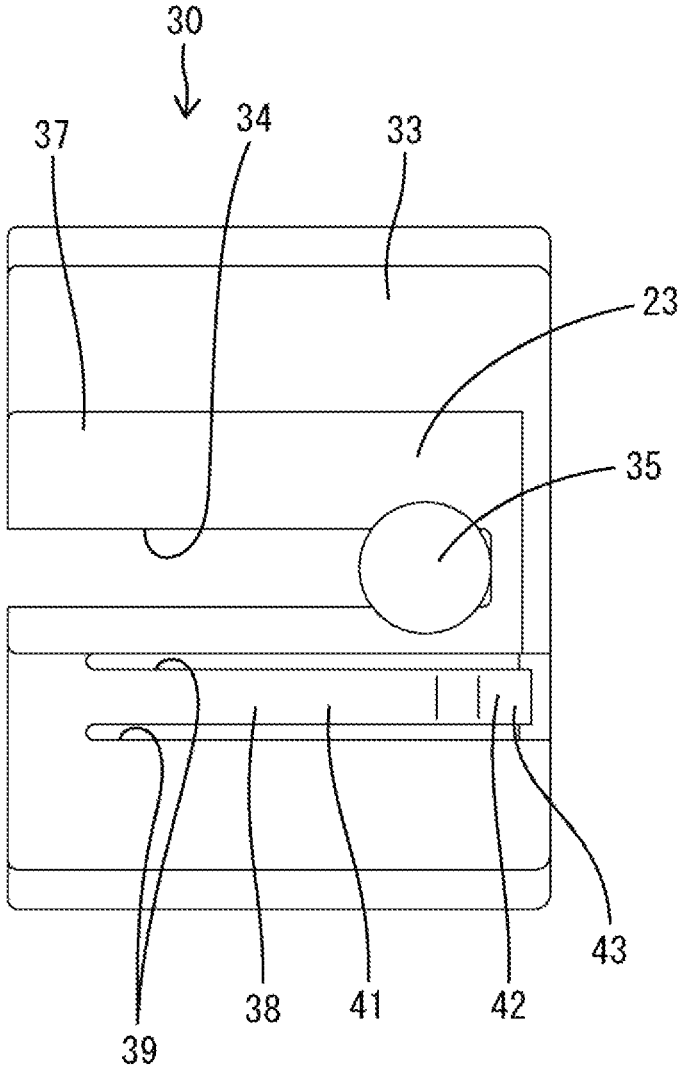
FIG. 6 is a side view of a moving plate.

A pair of male-side projections 23 are provided on both side surfaces of the moving plate 30 (both side surfaces of the wall portion 33) (see FIGS. 5 and 6). The male-side projection 23 is formed with a plate groove 34 open forward and extending long in the front-rear direction. The female-side projection 11 of the female housing 10 is insertable into the plate groove 34 from front.

The second cam 35 constituting a part of the cam pin engageable with the cam groove 58 of the lever 50 is provided on a rear end part of the male-side projection 23. The second cam 35 projects on the rear end part of the male-side projection 23 and has a substantially cylindrical outer shape. A receiving portion 36 into which the first cam portion 13 of the female-side projection 11 is insertable from front is provided inside the second cam portion 35. The second moving plate 35 stands in a rear end part of the plate groove 34 and the receiving portion 36 communicates with the plate groove 34.

The standing piece 37 stands on the upper surface of the male-side projection 23 over the entire length of the male-side projection 23. The standing piece 37 is substantially parallel to the outer surface of the wall portion 33.

The unlocking portions 38 displaceable to push the initial locking portions 54 of the lever 50 to be described later in an unlocking direction are formed on the wall portion 33 of the moving plate 30 (see FIG. 6). The unlocking portions 38 are described in detail later.

The lever 50 is made of synthetic resin and includes a pair of plate portions 51 extending along both left and right side surfaces (outer surface) of the receptacle 22 and a coupling portion 52 coupling the pair of plate portions 51. The plate portions 51 are provided with bearings 53 fittable to the support shafts 24 provided on the both left and right side surfaces of the male housing 20 (see FIG. 1). The bearings 53 are holes into which the support shafts 24 are finable.

The lever 50 is rotatable between an initial position (see FIG. 1) and a connection position (see FIG. 2) about the support shafts 24. By the rotation of the lever 50 from the initial position to the connection position, the male connector M and the female connector F are properly connected. When the lever 50 is at the initial position, the coupling portion 52 is located behind and above the male housing 20. When the lever 50 is at the connection position, the coupling portion 52 is located on the upper corner part of the front end of the male housing 20. The coupling portion 52 is provided with a locking mechanism 50R for restricting the rotation of the lever 50 toward the initial position by being locked to the male housing 20 when the lever 50 reaches the connection position.

The plate portion 51 of the lever 50 is provided with the initial locking portion 54 for limiting the rotation of the lever 50 toward the connection position by being locked to the groove portion 25 of the receptacle 22 when the lever 50 is at the initial position. The initial locking portion 54 is provided near the entrance of the cam groove 58. The initial locking portion 54 is in the form of a cantilever separated from other parts by slits 39 and resiliently displaceable in a thickness direction of the plate portion 51. At the initial position of the lever 50, an upper end side of the initial locking portion 54 is a free end and a lower end side thereof is a base end as shown in FIG. 1. The upper end of the initial locking portion 54 is located below the bearing 53.

As shown in FIG. 7, the initial locking portion 54 is provided with the lock projection 55 lockable to the locking surface 26 by entering the initial locking groove 25A of the receptacle 22. The lock projection 55 projects on the inner side of the upper end (free end) of the initial locking portion 54, and the lower surface of the lock projection 55 is locked to the locking surface 26 of the initial locking groove 25A. The lock projection 55 is inserted into a part of the initial locking groove 25A before a rear end part, so that a space portion 29 is present in the rear end part of the initial locking groove 25A. A front surface 56 of the lock projection 55 is formed into an inclined surface to gradually increase a projecting amount toward a rear side and a projecting surface 57 of the lock projection 55 is formed into a flat surface substantially parallel to the front-rear direction.

The moving plate 30 is provided with the unlocking portions 38 displaceable to push the initial locking portions 54 in the unlocking direction. As shown in FIG. 6, the unlocking portion 38 is formed by being separated from the surrounding by the long and narrow slits 39 in the wall portion 33 of the moving plate 30. The unlocking portion 38 is a part between a pair of the long and narrow slits 39 extending forward from the rear end of the wall portion 33, and the pair of slits 39 are substantially parallel to each other. One 39 of the pair of slits 39 extends along the lower edge of the male-side projection 23.

The unlocking portion 38 is in the form of a cantilever whose front end side is a base end and whose rear end side is a free end, and resiliently displaceable in an in-out direction of the wall portion 33.

As shown in FIG. 7, the unlocking portion 38 includes an extending portion 41 extending in the front-rear direction while having a thickness equivalent to that of the wall portion 33 and the disengaging projection 42 projecting outward on the rear end (free end) of the extending portion 41. The extending portion 41 extends in a direction substantially perpendicular to the initial locking portion 54 with the lever 50 located at the initial position.

Figure 8:
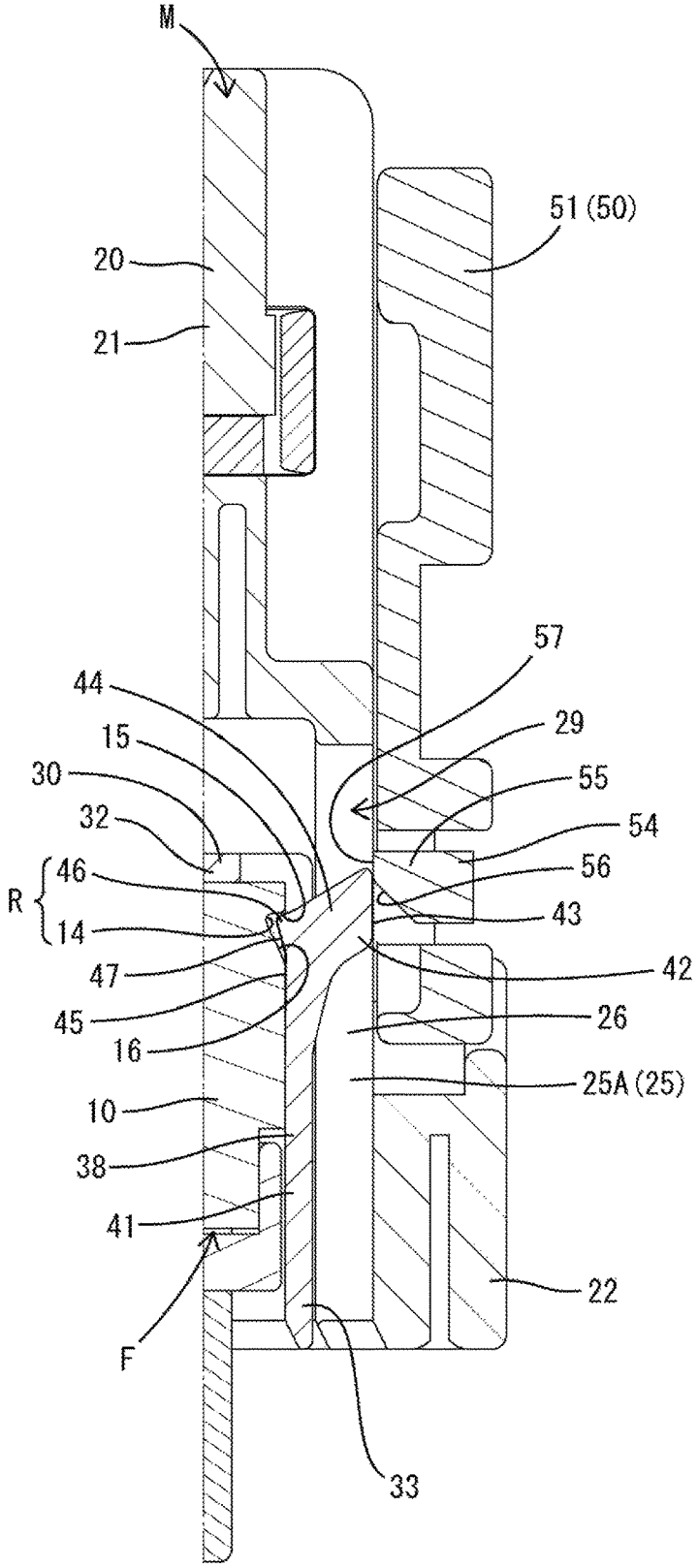
FIG. 8 is a cross-section at position A-A of FIG. 5 of the lever-type connector showing a state where the initial locking portion is unlocked.

The disengaging projection 42 can press the lock projection 55 of the initial locking portion 54 as the extending portion 41 is resiliently displaced. The disengaging projection 42 has a chevron shape and both front and rear surfaces thereof are inclined. With the unlocking portion 38 displaced to release initial locking, a rear surface 43 of the disengaging projection 42 is substantially parallel to the front-rear direction while being held in contact with the projecting surface 57 of the lock projection 55 as shown in FIG. 8.

The unlocking portion 38 includes a projecting portion 44 projecting inwardly of the wall portion 33. The unlocking portion 38 is displaced outwardly of the wall portion 33 by the contact of the outer surface of the female housing 10 with the projecting portion 44.

The projecting portion 44 is provided on a rear end part of the extending portion 41, projects over the entire width (width in the vertical direction) of the extending portion 41 and is formed in a range wider than the disengaging projection 42 in the front-rear direction (see FIG. 7).

The front surface of the projecting portion 44 is formed into a tapered surface (hereinafter, referred to as a first tapered surface 45) to gradually increase a projecting amount toward a front side in a connecting direction of the female housing 10. The first tapered surface 45 has a gentler gradient than the inclined surface of the disengaging projection 42.

As shown in FIG. 8, the unlocking portion 38 and the female housing 10 are provided with the separation restricting portions R for restricting the separation of the female housing 10 by locking each other. The separation restricting portions R include a projection 46 and a recess 14 fittable to each other in a state where the male connector M and the female connector F are temporarily connected (state where the cam pins are located in the cam grooves 58 and before the lever 50 at the initial position is rotated to the connection position).

The projection 46 projects on the unlocking portion 38. The projection 46 is provided on a projecting end (part where the front and rear inclined surfaces of the projecting portion 44 meet) of the projecting portion 44 of the unlocking portion 38. The projection 46 has a smaller width (vertical dimension in FIG. 5) than the projecting portion 44 and is located in a widthwise center of the projecting portion 44. The projection 46 has a chevron shape and both front and rear surfaces thereof are inclined. The front inclined surface of the projection 46 is formed into a tapered surface (hereinafter, referred to as a second tapered surface 47) to gradually increase a projecting amount toward the front side in the connecting direction of the female housing 10. The second tapered surface 47 has a steeper gradient than the first tapered surface 45.

The recesses 14 are formed by recessing the both left and right side surfaces of the female housing 10. The recess 14 is located below the female-side projection 11 (see FIG. 4). The recess 14 is so shaped that the projection 46 is fittable thereinto, and both front and rear surfaces thereof are inclined. As shown in FIG. 8, the front surface of the recess 14 serves as a catching surface 15 catchable on the rear surface of the projection 46. The catching surface 15 is at an angle substantially close to a right angle to the front-rear direction. The front surface of the recess 14 serves as an escaping surface 16 disposed at a distance from the projection 46. The escaping surface 16 is more gently inclined than the catching surface 15.

Next, an example of a connecting operation of the lever-type connector in this embodiment is described.

In the male connector M before connection, the moving plate 30 is held at the initial position (position where the plate body portion 32 is separated forwardly from the back surface of the receptacle 22) and the tip parts of the tab portions T are supported in the respective through holes 31 as shown in FIG. 7. Further, the lever 50 is disposed at the initial position and the lock projections 55 of the initial locking portions 54 are locked to the receptacle 22, thereby restricting the rotation of the lever 50. At this time, the initial locking portions 54 are in a natural state without being resiliently deformed. On the other hand, the disengaging projections 42 of the unlocking portions 38 are disposed near the lock projections 55 of the initial locking portions 54 and the projecting surfaces 57 of the lock projections 55 and the rear surfaces 43 of the disengaging projections 42 are proximate to or in contact with each other. The unlocking portions 38 are in a natural state without being resiliently deformed. Further, the second cam portions 35 of the moving plate 30 are located in the entrances of the cam grooves 58.

First, the male connector M and the female connector F are temporarily connected. When the female connector F is fit into the receptacle 22 of the male connector M, the outer surface of the female housing 10 comes into contact with the first tapered surfaces 45 of the projecting portions 44 of the unlocking portions 38 to gradually resiliently displace the unlocking portions 38 outwardly. Along with this, the disengaging projections 42 of the unlocking portions 38 push the lock projections 55 of the initial locking portions 54 outwardly, whereby the initial locking portions 54 are gradually resiliently displaced outwardly. Eventually, the outer surface of the female housing 10 contacts the second tapered surfaces 47 of the projections 46 to resiliently displace the unlocking portions 38 further outwardly. Then, the lock projections 55 of the initial locking portions 54 entirely project out from the groove portions 25. Thereafter, as shown in FIG. 8, when the female connector F reaches a temporary connection position, the recesses 14 of the female housing 10 reach the positions of the projections 46 of the unlocking portions 38 and the projections 46 are fit into the recesses 14, whereby the separation restricting portions R function. Along with this, the unlocking portions 38 and the initial locking portions 54 are slightly displaced inwardly. However, the lock projections 55 are entirely projecting out from the groove portions 25. In this way, the locked state of the initial locking portions 54 is released and the male connector M and the female connector F are temporarily connected.

With the female connector F and the male connector M temporarily connected, the front surface of the female housing 10 and the plate body portion 32 of the moving plate 30 are proximate to or in contact with each other. Further, the female-side projections 11 of the female housing 10 inserted and moved forward in the plate grooves 34 of the moving plate 30 reach the rear end parts of the plate grooves 34 and the first cam portions 13 are fit into the receiving portions 36 of the second cam portions 35. When the lever 50 is at the initial position, the first cam portions 13 can be separated from the receiving portions 36 of the second cam portions 35. Thus, the female connector F may fall by its own weight or another cause. However, according to the configuration of this embodiment, such separation of the female connector F can be prevented since the separation restricting portions R are functioning.

Subsequently, the lever 50 is rotated to the connection position. When the coupling portion 52 is pushed forwardly, the lever 50 rotates and side edge parts of the cam grooves 58 close the receiving portions 36 of the second cam portions 35, whereby the separation of the female connector F is restricted. Further, as the lever 50 is rotated, the moving plate 30 moves toward the back side of the receptacle 22 together with the female connector F and the disengaging projections 42 in the initial locking grooves 25A move rearward in the initial locking grooves 25A. Note that the projections 46 and the recesses 14 are kept locking each other.

Figure 9:
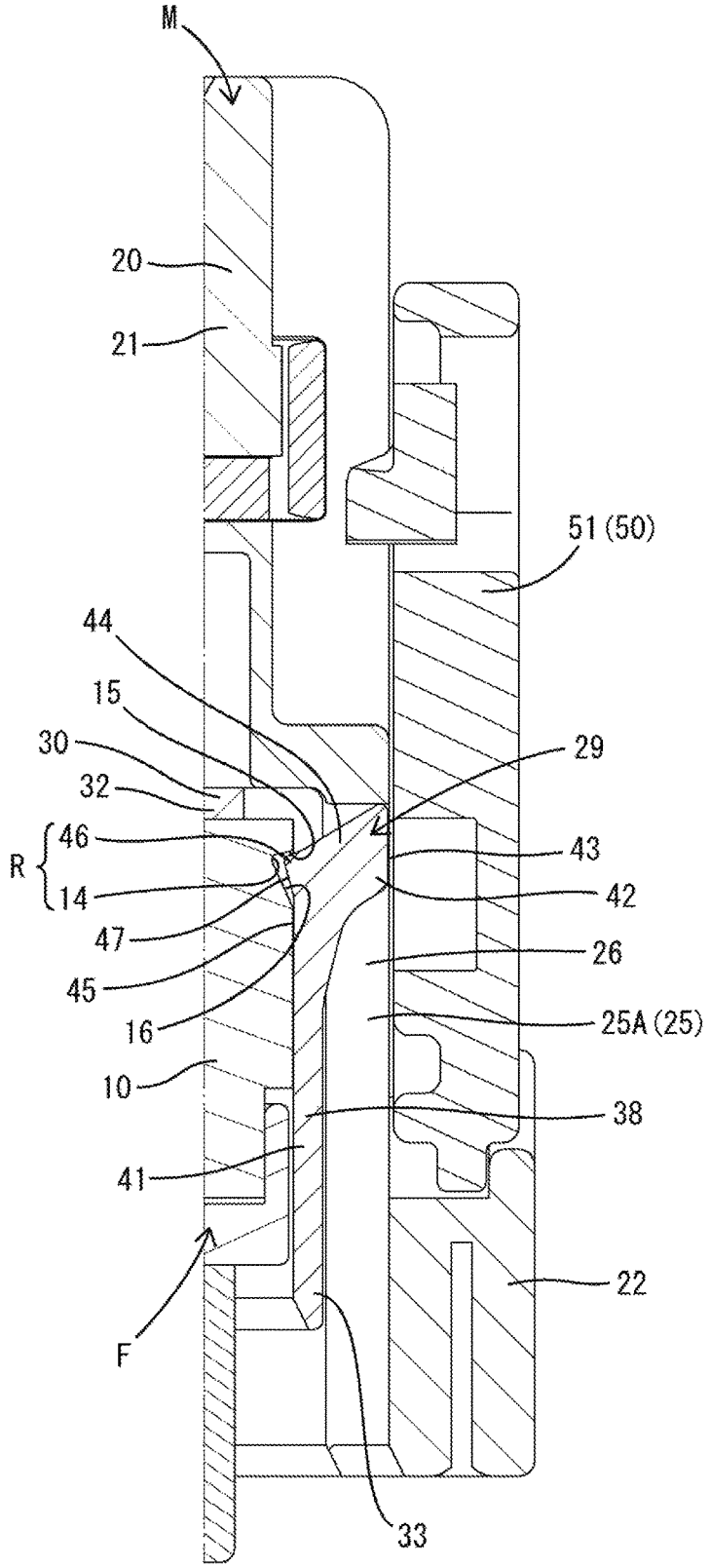
FIG. 9 is a cross-section at position A-A of FIG. 5, of the lever-type connector showing an unlocking portion when a properly connected state is reached.

Eventually, as shown in FIG. 9, the female connector F and the moving plate 30 reach the back end of the receptacle 22, the disengaging projections 42 enter the space portions 29 of the initial locking grooves 25A and the male terminal fittings and the female terminal fittings are electrically connected. The lever 50 reaches the connection position and the locking mechanism 50R of the lever 50 and the locking mechanism 20R of the male housing 20 act, thereby restricting a return of the lever 50 toward the initial position. In this way, the male connector M and the female connector F are properly connected.

Next, functions and effects of the embodiment configured as described above are described.

The lever-type connector of this embodiment includes the male housing 20 configured to accommodate the male terminal fittings including the tab portions T and the lever 50 rotatably mounted on the male housing 20 and configured to connect the male housing 20 and the female housing 10 by rotating from the initial position to the connection position. The male housing 20 includes the receptacle 22 capable of surrounding the tab portions T and the moving plate 30 having the through holes 31, through which the tab portions T can pass, and movable in the connecting direction of the male housing 20 and the female housing 10. The lever 50 includes the plate portions 51 extending along the outer surface of the male housing 20, and the moving plate 30 includes the wall portion 33 extending along the inner surface of the receptacle 22 and externally fittable to the female housing 10. The plate portions 51 of the lever 50 are provided with the initial locking portions 54 configured to limit the rotation of the lever 50 toward the connection position by being locked to the receptacle 22 when the lever 50 is at the initial position, and the wall portion 33 of the moving plate 30 is formed with the unlocking portions 38 displaceable to push the initial locking portions 54 in the unlocking direction by coming into contact with the female housing 10 fit inside the wall portion 33 and separated from the surrounding by the long and narrow slits 39. According to this configuration, since the wall portion 33 of the moving plate 30 needs not be formed with any large groove portion as before, strength can be enhanced. Therefore, a concern for insufficient strength of the moving plate 30 can be solved.

Further, the unlocking portion 38 includes the projecting portion 44 projecting inwardly of the wall portion 33 and is displaced by the contact of the outer surface of the female housing 10 with the projecting portion 44. Here, if releasing ribs for releasing initial locking are provided on side surfaces of a female housing as before, these ribs may be broken such as when the female housing falls. However, according to this embodiment, since it is not necessary to provide such ribs on the outer surface of the female housing 10, a concern for partial breakage of the female housing when the female housing falls can be eliminated. Further, since it is not necessary to provide releasing ribs on the female housing 10, the structure of the female housing 10 can be simplified.

Further, the projecting portion 44 of the unlocking portion 38 has the first tapered surface 45 to gradually increase the projecting amount toward the front side in the connecting direction of the female housing 10. According to this configuration, since a displacement amount of the unlocking portion 38 gradually increases as the female housing 10 moves forward, the male housing 20 and the female housing 10 can be smoothly connected.

Further, the unlocking portion 38 and the female housing 10 include the separation restricting portions R for restricting the separation of the female housing 10 by locking each other. According to this configuration, the detachment of the female housing 10 before the rotation of the lever can be prevented. Thus, the connection operability of the lever-type connector can be improved.

The invention is not limited to the above described and illustrated embodiment. For example, the following embodiments also are included in the scope of the invention.

Although the initial locking portions 54 and the unlocking portions 38 are in the form of cantilevers in the above embodiment, there is no limitation to this and both of these may be supported on both ends.

Although the unlocking portion 38 is provided with the projection 44 in the above embodiment, there is no limitation to this and a projection may be, for example, provided on a female housing without being provided on an unlocking portion. Even in such a case, since a projecting dimension of the projection can be made smaller than that of conventional releasing ribs, the female housing can be made difficult to break when it falls.

Although the projection 46 as the separation restricting portion R is provided on the unlocking portion 38 and the recess 14 is provided on the female housing 10 in the above embodiment, there is no limitation to this. For example, a projection may be provided on a female housing and a recess may be provided on an unlocking portion.

LIST OF REFERENCE SIGNS

R . . . separation restricting portion
T . . . tab
10 . . . female housing
20 . . . male housing
22 . . . receptacle
30 . . . moving plate
31 . . . through hole
33 . . . wall
38 . . . unlocking portion
39 . . . slit
44 . . . projection
45 . . . first tapered surface
50 . . . lever
51 . . . plate
54 . . . initial locking portion

What is claimed is:

1. A lever-type connector, comprising:

a male housing configured to accommodate a male terminal fitting including a tab; and a lever rotatably mounted on the male housing and configured to connect the male housing and a mating female housing by rotating from an initial position to a connection position, wherein:

the male housing includes a receptacle capable of surrounding the tab and a moving plate having a through hole, through which the tab is passed, and movable in a connecting direction of the male housing and the female housing;

the lever includes a plate extending along an outer surface of the male housing;

the moving plate includes a wall extending along an inner surface of the receptacle and externally fits to the female housing;

the plate of the lever includes an initial locking portion configured to limit the rotation of the lever toward the connection position by being locked to the receptacle when the lever is at the initial position; and the wall of the moving plate includes an unlocking portion displaceable to push the initial locking portion in an unlocking direction by coming into contact with the female housing fit inside the wall and the unlocking portion is formed by being separated from surroundings by a long and narrow slit.

2. The lever-type connector of claim 1, wherein the unlocking portion includes a projection projecting inwardly of the wall, and the unlocking portion is displaced by the contact of the outer surface of the female housing with the projection.

3. The lever-type connector of claim 2, wherein the projection of the unlocking portion has a tapered surface inclined to gradually increase a projecting amount toward a front side in the connecting direction of the female housing.

4. The lever-type connector of claim 3, wherein the unlocking portion and the female housing includes separation restricting portions configured to restrict the separation of the female housing by locking each other.

5. The lever-type connector of claim 1, wherein the unlocking portion and the female housing includes separation restricting portions configured to restrict the separation of the female housing by locking each other.

* * * * *